US009888762B2

(12) United States Patent
Kim et al.

(10) Patent No.: US 9,888,762 B2
(45) Date of Patent: Feb. 13, 2018

(54) FAN BRUSH COSMETIC APPLICATOR

(71) Applicant: AA R&D LLC, Leonia, NJ (US)

(72) Inventors: Elizabeth H. Kim, Leonia, NJ (US); Aiden T. Kim, Fort Lee, NJ (US)

(73) Assignee: AA R&D LLC, Leonia, NJ (US)

( * ) Notice: Subject to any disclaimer, the term of this patent is extended or adjusted under 35 U.S.C. 154(b) by 0 days.

(21) Appl. No.: 14/683,959

(22) Filed: Apr. 10, 2015

(65) Prior Publication Data

US 2016/0295992 A1 Oct. 13, 2016

(51) Int. Cl.

| | |
|---|---|
| ***A46B 3/16*** | (2006.01) |
| ***A46B 9/02*** | (2006.01) |
| ***A46B 3/08*** | (2006.01) |
| *A45D 34/04* | (2006.01) |
| *A45D 40/26* | (2006.01) |

(52) U.S. Cl.

CPC ..... *A46B 3/16* (2013.01); *A46B 3/08* (2013.01); *A46B 9/021* (2013.01); *A45D 34/045* (2013.01); *A45D 40/265* (2013.01)

(58) Field of Classification Search

CPC ..... A46B 2200/1046; A46B 3/08; A46B 3/16; A46B 9/021; A46B 9/026; A46D 3/05; A46D 3/042

USPC ..... 15/191.1, 195, 199, 190

See application file for complete search history.

(56) References Cited

U.S. PATENT DOCUMENTS

| | | | | |
|---|---|---|---|---|
| 5,590,438 | A * | 1/1997 | Chen | A46B 3/16 15/167.1 |
| 6,176,631 | B1 | 1/2001 | Gueret | |
| 7,465,113 | B2 * | 12/2008 | Gueret | A46B 9/021 15/168 |
| 7,996,947 | B2 * | 8/2011 | Gueret | A45D 34/045 15/167.3 |
| 2007/0110501 | A1 | 5/2007 | Gueret | |
| 2009/0038094 | A1 * | 2/2009 | Kim | A45D 34/042 15/160 |

FOREIGN PATENT DOCUMENTS

| | | | |
|---|---|---|---|
| JP | 11-244040 | A | 9/1999 |
| KR | 10-2004-0011987 | A | 2/2004 |

OTHER PUBLICATIONS

Office Action dated Jul. 5, 2017, issued in counterpart Chinese Application No. 201610202796.8, with English translation. (10 pages).

Office Action dated Aug. 4, 2017, issued in counterpart Korea Application No. 10-2016-0041056, with English translation. (11 pages).

* cited by examiner

*Primary Examiner* — Laura C Guidotti

(74) *Attorney, Agent, or Firm* — Westerman, Hattori, Daniels & Adrian, LLP

(57) ABSTRACT

A cosmetics brush for applying cosmetics. The brush includes a rod, a ferrule formed at the end of the rod, the ferrule defining an insertion groove, and a bundle of fibers inserted in the ferrule. The insertion groove extends from an opening to a closed end and is defined by opposed side walls and opposed front and rear inside walls. The opposed side walls taper toward one another moving from the opening to the closed end.

11 Claims, 5 Drawing Sheets

FAN BRUSH COSMETIC APPLICATOR

FIELD OF THE INVENTION

The present invention relates to a cosmetics brush and a manufacturing method therefore. The cosmetics brush includes a ferrule defining a fiber bundle insertion groove with tapered side walls which define a fan brush configuration.

BACKGROUND OF THE INVENTION

A general form of cosmetics brushes used for applying such cosmetics as rouge, lip gloss, mascara, eye liner, and manicure comprises a brush handle holding a bundle of fibers and a cap at an end of the handle, screw-coupled to a cosmetics container, so that the fiber bundle is stored inside of the cosmetics container for good portability, being dipped in the cosmetics, and can be used to apply cosmetics adhered to the bristles by simply detaching the cap.

Since a cosmetics brush of this formation has a bundle of fibers, inserted in an end of the handle, formed in a cylindrical shape, and a cap screw-coupled to the cosmetics container, the fiber bundle is twisted in the cosmetics when rotated together with the cap by the resistance of the liquid cosmetics usually having a higher viscosity. Further, if the fiber bundle is formed in a cylindrical shape, it has a weak force of restitution and difficult to return to its proper shape and apply the cosmetics uniformly, resulting in inconvenience of the user.

In addition, it is important for making-ups using cosmetics brushes to apply cosmetics at a constant thickness and width, however, the fiber bundles having a cylindrical shape are disadvantageous for applying cosmetics at a constant thickness and width even though they are not twisted.

SUMMARY OF THE INVENTION

In at least one embodiment, the present invention provides a cosmetics brush for applying cosmetics. The brush includes a rod, a ferrule formed at the end of the rod, the ferrule defining an insertion groove, and a bundle of fibers inserted in the ferrule. The insertion groove extends from an opening to a closed end and is defined by opposed side walls and opposed front and rear inside walls. The opposed side walls taper toward one another moving from the opening to the closed end.

In at least one embodiment, the bundle of fibers is configured such that the fibers fan out based on the configuration of the insertion groove.

In at least one embodiment, the free ends of the fibers define an end region and the end region has a linear configuration which extends perpendicular to the rod.

In at least one embodiment, the free ends of the fibers define an end region and the end region has a convex arcuate configuration.

In at least one embodiment, the free ends of the fibers define an end region and the end region has a concave arcuate configuration.

In at least one embodiment, an angle of taper of each side wall is constant from the opening to the closed end.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
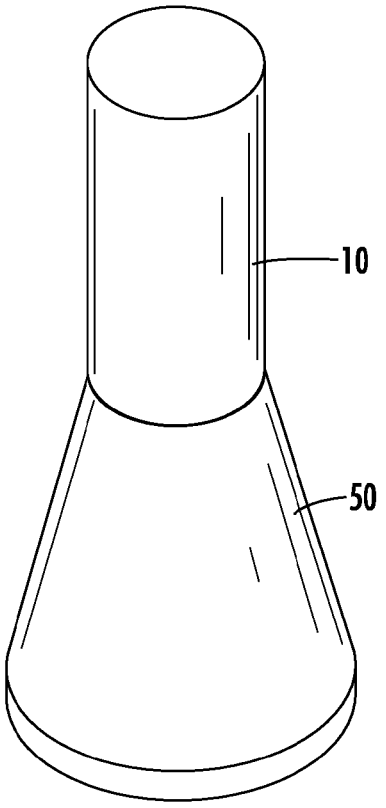
FIG. 1 is a perspective view of a cosmetics brush in accordance with an embodiment of the invention coupled with a cosmetics container.
Figure 2:
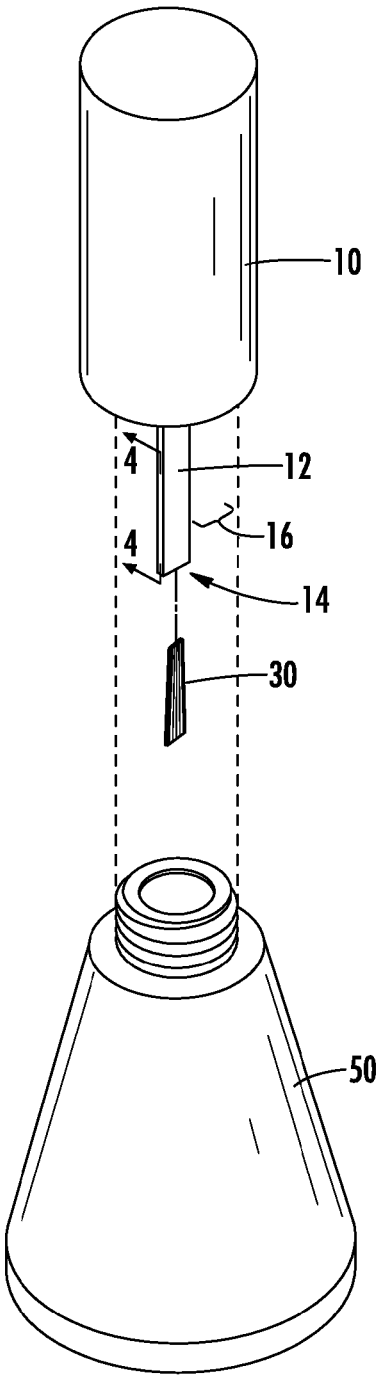
FIG. 2 is a perspective view of the cosmetics brush of FIG. 1 separated from the cosmetics container.

In the drawings, like numerals indicate like elements throughout. Certain terminology is used herein for convenience only and is not to be taken as a limitation on the present invention. The following describes preferred embodiments of the present invention. However, it should be understood, based on this disclosure, that the invention is not limited by the preferred embodiments described herein.

Referring to FIGS. 1-5, a cosmetics brush 10 in accordance with an embodiment of the invention will be described. The cosmetics brush 10 includes a rod 12, a ferrule 14 for fibers, a fiber bundle 30, and a fixing piece 16. The cosmetics brush is engaged with a cosmetics container 50 with screw threads with the rod 12 and the fiber bundle 30 stored inside of the cosmetics container 50 to improve portability and enable application of cosmetics simply by separating the container cap 11, because the fiber bundle is dipped in and coated with the cosmetics.

Figure 8:
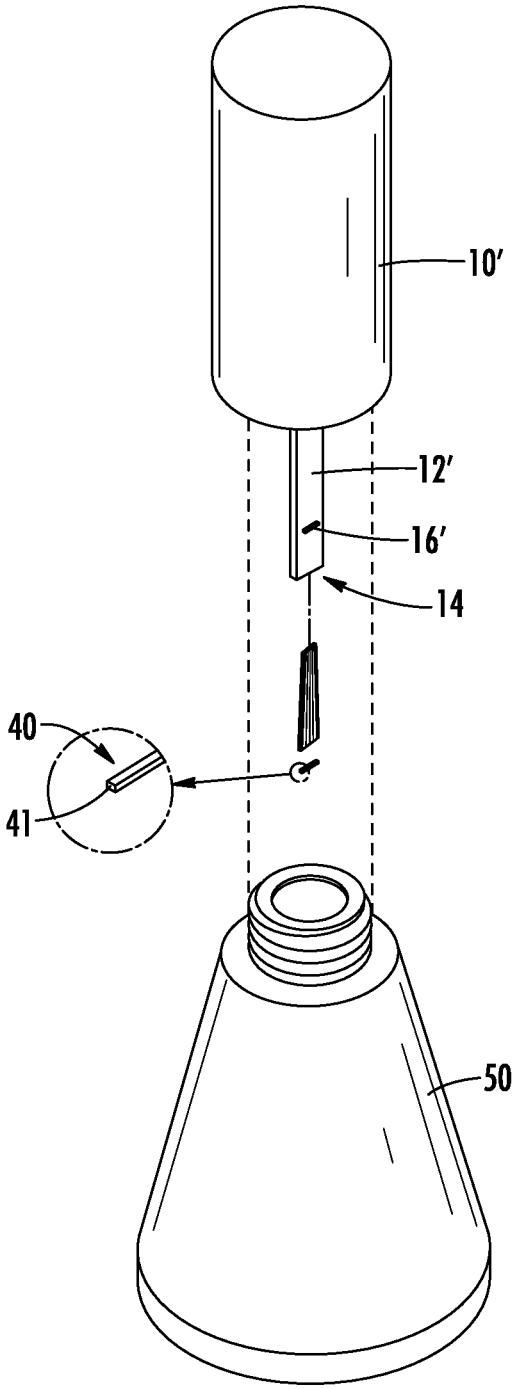
FIG. 8 is a perspective view of a cosmetics brush in accordance with another embodiment of the invention separated from a cosmetics container.

In an exemplary embodiment, the rod 12 is formed with a plastic resin by injection molding at a length fit to be stored inside of a cosmetics container 50 and coated with cosmetics in the container. The head portion of the rod 12 is wider to be press-fitted inside of the container cap 11 and the lower portion of the rod 12 is provided with the ferrule 14 which is formed in integration. The ferrule 14 includes an insertion groove 20 configured to receive an end of the fiber bundle 30 such that the free ends of the fibers 32 extend away from the rod 12. In the illustrated embodiment, the fixing piece 16 is in the form of a staple which passes through the rod 12 and fiber bundle 30 to fix the bundle within the insertion groove 20. While a staple is illustrated in the present embodiment as the fixing element, FIG. 8 illustrates an alternative brush 10' wherein the rod 12' includes a detent which serves as the fixing piece 16'. Furthermore, a secondary fixing piece 40, a cross bar with ends 41 configured to engage the inside walls 24 of the insertion groove 20, may also be utilized. In all other respects, the brush 10' is the same as described with respect to the brush 10. Other fixing pieces other than those illustrated may also be utilized.

The fiber bundle 30, which is coated with the cosmetics in the cosmetics container 50, comprises approximately 1000 filaments of raw fiber 32, maintained in a spread form, made of polyamide and formed with a diameter of between from about 0.05 to 0.09 mm. More preferably, the number of the raw fibers 32 should be between from about 980 to 1020. This range of raw fibers provides good adhesive property of cosmetics in liquid status, without separation and excellent result or response in make-up tests.

Figure 3:
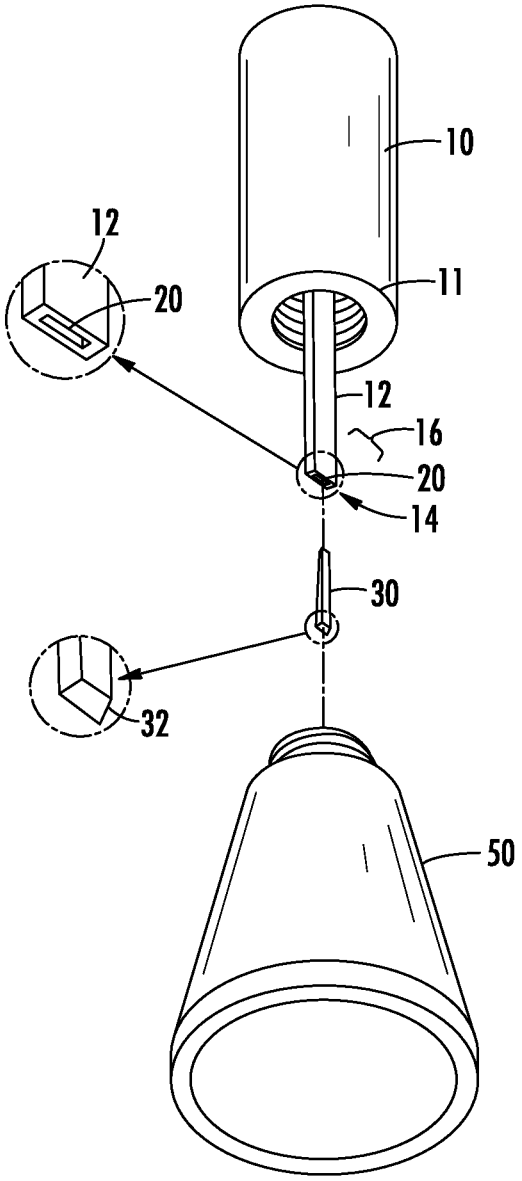
FIG. 3 is a perspective, bottom view of the cosmetics brush of FIG. 1 separated from a cosmetics container.
Figure 4:
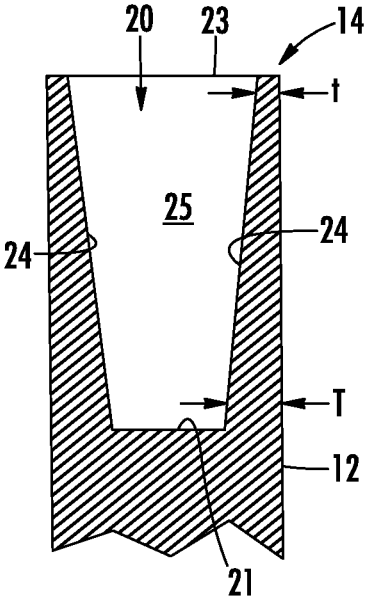
FIG. 4 is a cross-sectional view along the line 4-4 in FIG. 2.
Figure 5:
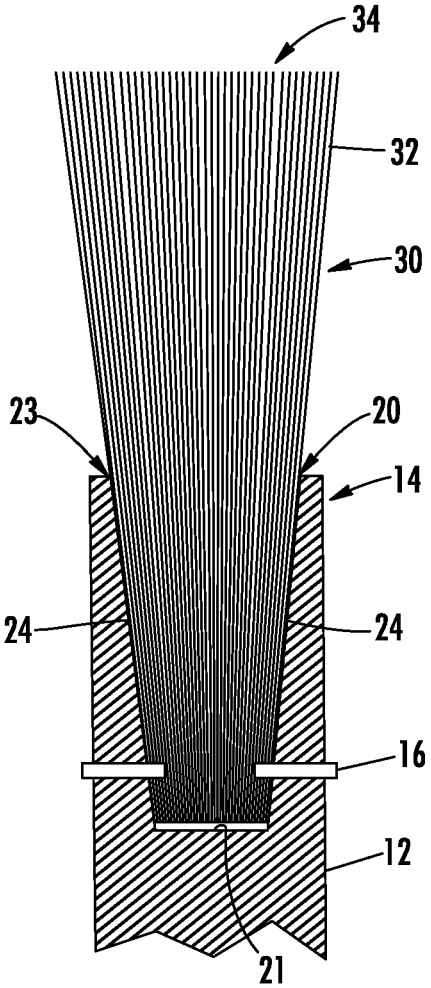
FIG. 5 is a cross-sectional view similar to FIG. 4 illustrating an exemplary fiber bundle positioned in the insertion groove.

Referring to FIGS. 3-5, the ferrule 14, preferably formed in integration with the rod 12 by injection molding, maintains the fiber bundle 30 in a spread formation. The fiber bundle insertion groove 20 is formed with a rectangular cross-section whose transverse width W is longer than the longitudinal width W' so that the shape of the fiber bundle 30 is maintained in a flat, broad form enabling uniform application and reduced consumption of cosmetics. While the illustrated cross-sectional shape of the fiber bundle insertion groove 20 is a rectangle, the shape is not limited to a rectangle but also can be a polygonal, a circle, or any other form as appropriate.

The insertion groove 20 extends from an opening 23 to a closed end 21 within the rod 12. The opposed side walls 24 taper inward moving from the opening 23 to the closed end 21. Preferably, the angle of the taper is constant from the opening 23 to the closed end 21, however, it is understood that different portions of the side walls 24 may be angled at differing angles. In the illustrated embodiment, the front and rear inside walls 25 of the insertion groove 20 (only one of which is illustrated in FIG. 4) extend parallel to one another, however, it is contemplated that one or both of the front and rear inside walls 25 may also be tapered, either toward one another moving toward the opening 23 or away from one another moving toward the opening 23.

With the tapered side walls 24, the ferrule 14 surrounding the insertion groove 20 has a greater thickness T proximate the closed end 21 than the thickness t proximate the opening 23. The greater thickness T provides a more robust structure for receiving the fixing piece 16. Additionally, the narrower closed end allows for more material around the fixing piece 16 for a more effective connection.

Figure 6:
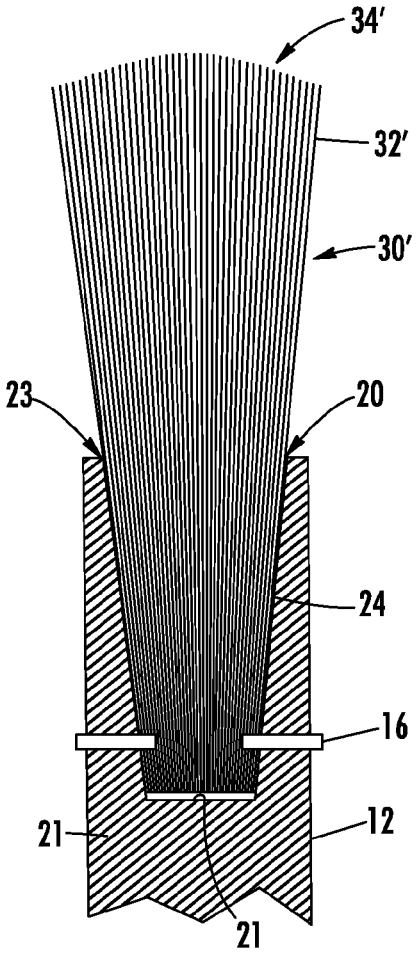
FIGS. 6 and 7 are views similar to FIG. 5 illustrating additional exemplary fiber bundles positioned in the insertion groove.
Figure 7:
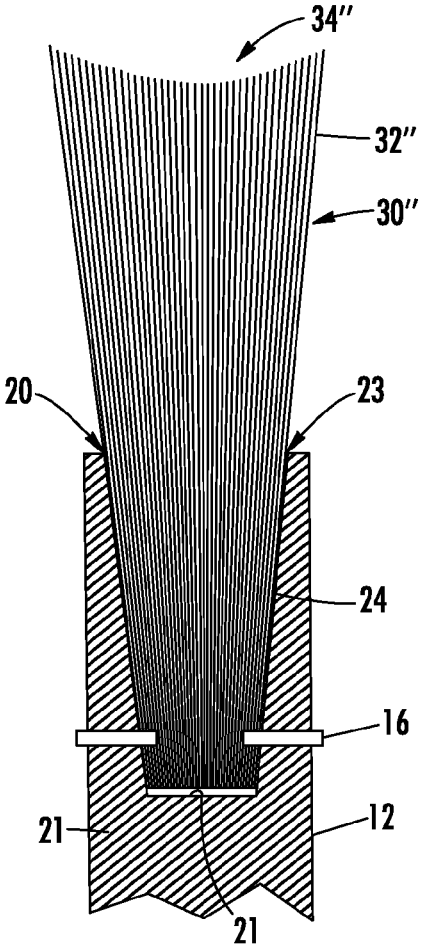

The angle of the tapered side walls 24 may be selected to define a desired fanning of the bristles 32 of the fiber bundle 30. The bristles 32 extend along the side walls 24 such that a precise fan may be formed. In the illustrated embodiment, the bristles 32 are trimmed or formed such that the end region 34 of the fiber bunch 30 has a linear configuration. The linear end region 34 may extend perpendicular to the rod 12, as illustrated, or may be otherwise angled such that one side of the fan is longer than the other side. FIGS. 6 and 7 illustrate fiber bundles 30', 30" with other exemplary end region 34', 34" configurations. In the embodiment illustrated in FIG. 6, the bristles 32' are configured such that the end region 34' has a convex arcuate configuration. In the embodiment illustrated in FIG. 7, the bristles 32" are configured such that the end region 34" has a concave arcuate configuration. The exemplary embodiments are for illustration, however, it is understood that the end region 34 of the fiber bundle 30 may have any desired configuration.

These and other advantages of the present invention will be apparent to those skilled in the art from the foregoing specification. Accordingly, it will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as defined in the claims.

What is claimed is:

1. A cosmetics brush for applying cosmetics, comprising:

a rod;

a ferrule formed at the end of the rod, the ferrule defining an insertion groove;

a bundle of fibers inserted in the ferrule; and a fixing piece passing through both of the rod and the bundle of fibers for fixing the bundle of fibers within the insertion groove, wherein the insertion groove extends from an opening to a closed end and is defined by opposed side walls and opposed front and rear inside walls, wherein the opposed side walls taper toward one another moving from the opening to the closed end, wherein one or both of the front and rear inside walls also taper, either toward one another moving toward the opening or away from one another moving toward the opening, and wherein angles of taper of the opposed side walls and one or both of the front and rear inside walls are constant from the opening to the closed end, wherein the closed end is an innermost portion of the insertion groove, wherein the fixing piece is not a staple, and wherein the cosmetics brush further comprises a secondary fixing piece with a cross bar with ends configured to engage the inside walls of the insertion groove.

2. The cosmetics brush according to claim 1 wherein the front and rear inside walls extend parallel to one another.

3. The cosmetics brush according to claim 1 wherein the insertion groove has a rectangular cross-section.

4. The cosmetics brush according to claim 1 wherein the bundle of fibers is configured such that the fibers fan out based on the configuration of the insertion groove.

5. The cosmetics brush according to claim 1 wherein the free ends of the fibers define an end region and the end region has a linear configuration.

6. The cosmetics brush according to claim 5 wherein the linear configuration extends perpendicular to the rod.

7. The cosmetics brush according to claim 1 wherein the free ends of the fibers define an end region and the end region has a convex arcuate configuration.

8. The cosmetics brush according to claim 1 wherein the free ends of the fibers define an end region and the end region has a concave arcuate configuration.

9. The cosmetics brush according to claim 1 wherein the ferrule has a constant external configuration and the thickness between an outside surface of the ferrule and a respective side wall of the insertion groove is larger proximate the closed end than the thickness proximate the opening.

10. The cosmetics brush according to claim 9 wherein the fixing piece extends through the fiber bundle and at least a portion of the ferrule proximate the closed end.

11. A method of forming a cosmetics brush, the method comprising:

forming a rod with a ferrule defining an insertion groove therein, the insertion groove extends from an opening to a closed end and is defined by opposed side walls and opposed front and rear inside walls, wherein the opposed side walls taper toward one another moving from the opening to the closed end, wherein one or both of the front and rear inside walls also taper, either toward one another moving toward the opening or away from one another moving toward the opening, wherein angles of taper of the opposed side walls and one or both of the front and rear inside walls are constant from the opening to the closed end, and wherein the closed end is an innermost portion of the insertion groove;

positioning a bundle of fibers in the insertion groove such that free ends of the fibers extend from the opening and the fibers are free to form a fan shape corresponding to the configuration of the insertion groove;

fixing the fiber bundle within the insertion groove by using a fixing piece which passes through both of the rod and the fiber bundle, wherein the fixing piece is not a staple, and using a secondary fixing piece with a cross bar with ends configured to engage the inside walls of the insertion groove.

* * * * *